US005460634A

United States Patent [19]

Fava et al.

[11] Patent Number: 5,460,634

[45] Date of Patent: Oct. 24, 1995

[54] FUEL OIL TREATMENT

[75] Inventors: Carlo Fava, Oxford, United Kingdom; Wolfgang W. J. Gschwendtner, Cologne, Germany; Anthony K. Smith, Reading, United Kingdom; Michael D. Sexton; Richard J. Hart, both of Didcot, United Kingdom

[73] Assignee: Exxon Chemical Patents Inc., Linden, N.J.

[21] Appl. No.: 167,950

[22] PCT Filed: Jul. 1, 1992

[86] PCT No.: PCT/EP92/01481

§ 371 Date: Feb. 28, 1994

§ 102(e) Date: Feb. 28, 1994

[87] PCT Pub. No.: WO93/01260

PCT Pub. Date: Jan. 21, 1993

[30] Foreign Application Priority Data

Jul. 2, 1991 [GB] United Kingdom ..... 9114237

[51] Int. Cl.[6] ..... C10L 1/22

[52] U.S. Cl. ..... 44/423; 44/329; 44/335; 44/388

[58] Field of Search ..... 44/423

[56] References Cited

U.S. PATENT DOCUMENTS

| | | | |
|---|---|---|---|
| 2,734,814 | 2/1956 | Thompson | 252/0.5 |
| 3,219,424 | 11/1965 | Case et al. | 44/63 |
| 4,398,505 | 8/1983 | Cahill | 44/57 |
| 4,637,886 | 1/1987 | Brois et al. | 252/51.5 A |
| 4,670,131 | 6/1987 | Ferrell | 208/48 AA |
| 4,880,923 | 11/1989 | Brois et al. | 540/471 |

FOREIGN PATENT DOCUMENTS

| | | |
|---|---|---|
| 147240 | 7/1985 | European Pat. Off. . |
| 203692 | 12/1986 | European Pat. Off. . |
| 230366 | 7/1987 | European Pat. Off. . |
| 232069 | 8/1987 | European Pat. Off. . |
| 290088 | 11/1988 | European Pat. Off. . |
| 353713 | 2/1990 | European Pat. Off. . |
| 1206228 | 6/1958 | France . |
| 2010029 | 4/1969 | France . |
| 86/00333 | 1/1986 | WIPO . |
| 91/16408 | 10/1991 | WIPO . |
| 93/01260 | 1/1993 | WIPO . |

OTHER PUBLICATIONS

PCT International Examination Report, PCT/EP92/01481, Jan. 7, 1992.

*Primary Examiner*—Ellen M. McAvoy
*Attorney, Agent, or Firm*—John J. Mahon

[57] ABSTRACT

An additive comprising an oil-soluble stable free radical, such as a nitroxide, or a precursor therefor, is used in a fuel oil to reduce, on combustion of the fuel oil, one or more of particulate emissions, hydrocarbon emissions, carbon monoxide emissions, and oxides of nitrogen emissions.

24 Claims, No Drawings

FUEL OIL TREATMENT

This invention relates to the use of additives in fuel oils to reduce emissions on combustion of the fuel oil and to increase engine power when used in an internal combustion engine.

Although modern internal combustion engines are highly efficient and give almost complete combustion of the hydrocarbon fuel used, the slight reduction from total efficiency leads to the formation of black smoke, a proportion of which is particulate carbon and other products of incomplete combustion. Apart from the smoke being unpleasant to breathe and unsightly, the carbon particles may have absorbed in them polynuclear hydrocarbons, which also result from incomplete combustion, some of which are known carcinogens.

Furthermore, internal combustion engines give rise to gaseous emissions on combustion of fuel therein, examples of such emissions being one or more hydrocarbons, carbon monoxide, and oxides of nitrogen and which examples are noxious and undesirable.

U.S. Pat. No. 4,398,505 describes diesel fuel compositions including N,N-disubstituted organic nitroxides, which are organic free radicals, in amounts effective to increase the cetane number of the fuel. Such amounts are stated to ordinarily be in the range from about 0.01 to 5 weight percent based on the total weight of the resulting fuel, preferably from about 0.1 to about 3 weight percent. However, U.S. Pat. No. 4,398,505 neither discloses nor suggests that organic free radicals such as those disclosed therein are capable of reducing emissions on combustion of the fuel. This effectiveness has now been found, according to this invention. Thus, the invention provides in one aspect the use as an additive in a fuel oil to reduce, on combustion of the fuel oil, one or more of particulate emissions, hydrocarbon emissions, carbon monoxide emissions, and oxides of nitrogen emissions, the additive comprising an oil-soluble stable free radical or a precursor therefor.

Furthermore, U.S. Pat. No. 4,398,505 neither discloses nor suggests the use of organic free radicals in amounts less than those effective to increase the cetane number of the fuel. It has now been found, according to this invention, that such amounts are effective in reducing emissions on combustion of fuels. Thus, in a second aspect, the invention provides a composition comprising a major proportion of a fuel oil and, dissolved therein, a minor proportion of an additive comprising an oil-soluble free radical or a precursor therefor, the minor proportion of the additive being such that it is incapable of increasing the cetane number of the fuel oil; and in a third aspect, the invention provides a method for operating a diesel engine to reduce one or more of particulate emissions, hydrocarbon emissions, carbon monoxide emissions, and oxides of nitrogen emissions in operation of the engine, which method comprises operating the engine using a composition comprising a major proportion of a fuel oil and a minor proportion of an additive comprising an oil-soluble stable free radical or a precursor therefor, the minor proportion of the additive being such that it is incapable of increasing the cetane number of the fuel oil.

Moreover, U.S. Pat. No. 4,398,505 neither discloses nor suggests using organic free radicals in additive combinations with co-additives. Such combinations have been found to be surprisingly beneficial according to the invention and, in a fourth aspect, the invention provides an additive combination comprising an oil-soluble stable free radical or a precursor therefor and one or more co-additives as defined hereinafter in this specification. Such a combination may be included in a fuel oil composition or in a concentrate for addition to a fuel oil.

It is noteworthy in the present invention that the organic free radicals or precursors therefor, when incorporated in a diesel, heating or jet fuel, may reduce the emissions of particulates even in the absence of injector deposits. Thus the reduction in particulate emission achieved by the present invention may result directly on combustion of a fuel containing the free radical or precursor, compared with the emissions resulting from combustion, in the same combustion chamber with the same conditions upstream of the combustion chamber, of fuel not containing the free radical or precursor but otherwise identical. Such reduction is herein referred to as the "direct" reduction.

While the applicants do not wish to be bound by any theory, it is believed that under given conditions (which include any deposits present in injectors or elsewhere upstream of the combustion chamber) the presence of the free radical or precursor in the fuel, or in the fuel/air mixture, in the combustion chamber results in an improvement in the quality of combustion, as measured by completeness of oxidation. This improvement may in turn be the result of a change in the physical properties of the fuel, or the fuel/air mixture, e.g. the surface tension of the fuel, resulting in improved mixing and reduced soot and smoke formation. The reference above to the presence of the free radical or precursor includes the presence of a reaction product of the free radical or precursor with a component of the fuel, the reaction having taken place either before entry into the combustion chamber or within the combustion chamber prior to combustion.

The features of the invention will now be discussed in further detail.

ADDITIVE

Stable free radicals or precursors therefor such as can be used in this invention are described in U.S. Pat. No. 4,670,131, which describes their use in controlling fouling in equipment for processing and storing hydrocarbon compositions containing unsaturated hydrocarbons.

By "stable free radical" in this specification is meant a free radical that can be prepared by conventional chemical methods and that can exist long enough under the conditions of combustion of a fuel oil for it to be able to influence combustion to reduce one or more of the above-mentioned emissions. Generally, the free radical should be capable of existing under such conditions for longer than the time of the combustions reactions occurring during combustion.

By "precursor" in this specification is meant a chemical species that is convertible to the stable free radical during the combustion.

Examples of stable free radicals for use in this invention are: nitroxides, hindered phenoxys, hydrazyls, stabilised hydrocarbon radicals, and polyradicals of the afore-mentioned free radicals. Examples of precursors for stable free radicals are: nitrones, nitrosos, thioketones, benzoquinones, and hydroxylamines.

In this invention, preferred nitroxides are of the formula:

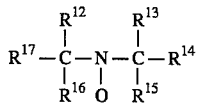

wherein each of $R^{17}$, $R^{12}$ and $R^{13}$ and $R^{14}$ is a hydrocarbyl group or hetero-atom substituted hydrocarbyl group having 1 to 200 carbon atoms, $R^{15}$ and $R^{16}$ (a) each being a hydrocarbyl group having 1 to 200 carbon atoms, or a substituted hydrocarbyl group having 1 to 200 carbon atoms wherein the substituent is halogen, cyano, —$CONH_2$, —$SC_6H_5$, —S—$COCH_3$, —$OCOCH_3$, — $OCOC_2H_5$, carbonyl, alkenyl wherein the double bond is not conjugated with the nitroxide moiety, or —COOR wherein R of the —COOR group is alkyl or aryl, or (b) together forming part of a ring that contains carbon atoms and up to two hetero-atoms of O, N or S, optionally linked to a side chain for enhancing the solubility of the free radical in a fuel oil.

"Hydrocarbyl" means an organic moiety composed of carbon and hydrogen which may be aliphatic, including alicyclic; aromatic; or any combination thereof, e.g. aralkyl. For example, the moiety may be a polymonoolefin group such as polyisobutylene. Preferably, one or more of the hydrocarbyl groups is an alkyl group having 1 to 15 carbon atoms. When hetero atom substituted, the hetero atom may be nitrogen, oxygen or sulphur; there may be one or more such hetero atoms.

In the above formula, it is preferred that the ring, where present, contains 4 to 8 such as 4 or 5 carbon atoms. Examples of the optional side chain are groups of the same definition of $R^{15}$ and $R^{16}$ herein which may optionally be linked to the ring via a functional group, examples of which being —NH—; —S—; —O—; —CO—; —CS—; —CO—NH—; —CS—NH—; —O—CO—NH—; —O—CS—NH—; —S—CO—NH—; —S—CS—NH—; —O—O—; >C=N—; and >C=N—O—.

The selection of such a functional group may be determined primarily by manufacturing ease; otherwise its selection may not be critical.

Preferably, each of $R^{17}$, $R^{12}$, $R^{13}$ and $R^{14}$ is a methyl, ethyl or propyl group. Also, each of $R^{15}$ and $R^{16}$ may be a methyl, ethyl or propyl group. A specific example of a nitroxide for use in this invention is: 4 -hydroxy-2,2,6,6-tetramethylpiperindinyloxy.

The additive may, when the invention is the use or the composition, be present in the fuel oil in a proportion in the range of from 1 to 1000 ppm of active ingredient by weight based on the weight of the fuel oil. Preferably the proportion is in the range of 4 to 500 ppm. More preferably, and as stated above in respect of the fuel composition and method aspects of this invention, the proportion is insufficient to influence or change the cetane number of the fuel. It is, for example, less than 100 ppm such as less than 80 ppm, notably 1 to 50 ppm.

CO-ADDITIVES

The additives of the invention may be used in combination with one or more co-additives. Particular noteworthy co-additives are the ashless dispersants which are described in numerous patent specifications and which are additives that leave little or no metal-containing residue on combustion. Many classes are known such as described in EP-A-0 482 253 and to which attention is directed for further details thereof. Examples of co-additives, which include examples of ashless dispersants, are as follows:

(i) Macrocyclic Compound

Such a compound is an oil soluble compound of the formula

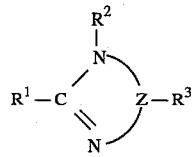

(I)

or $R^6R^4N(R^5)_b[NR^4(R^5)_c]_dNR^4R^4$ or mixtures of two or more such compounds, wherein $R^1$, $R^2$ and $R^3$ may be the same or different and are independently hydrogen or a hydrocarbyl substituent having from 2 to 600 carbon atoms, or a keto, hydroxy, nitro, cyano, or alkoxy derivative thereof, provided that at least one of $R^1$, $R^2$ and $R^3$ is a hydrocarbyl substituent having from 2 to 600 carbon atoms or said derivative thereof, or wherein $R^1$ and $R^2$ together form a hydrocarbylene substituent having 4 to 600 carbon atoms or a keto, hydroxy, nitro, cyano or alkoxy derivative thereof, provided that $R^1$ and $R^2$ together with the carbon atom which forms the C-R1 bond with $R^1$ and the nitrogen atom which forms the N-$R^2$ bond with $R^2$ form a ring having at least 5 members, wherein Z represents $$—R^{10}[NR^{11}(R^{10})]_e—$$

or $$—[R^{10}R^{11}N]_fR^{10}[NR^{11}R^{10}]_g—$$

wherein each $R^{10}$, which may be the same or different, represents an alkylene group having from 1 to 5 carbon atoms in its chain, $R^{11}$ represents a hydrogen atom or a hydrocarbyl group, and e is from 0 to 6, f is from 1 to 4, g is from 1 to 4, provided that f+g is at most 5, each $R^4$ is independently H or an alkyl group having up to 5 carbon atoms, $R^5$ is an alkylene group having up to 6 carbon atoms in the chain, optionally substituted by one or more hydrocarbyl groups having up to 10 carbon atoms, an acyl group having from 2 to 10 carbon atoms, or a keto, hydroxy, nitro, cyano or alkoxy derivative of a hydrocarbyl group having from 1 to 10 carbon atoms or of an acyl group having from 2 to 10 carbon atoms, R6 is a hydrocarbyl substituent having from 2 to 600 carbon atoms or said derivative thereof, b is from 1 to 6, c is from 1 to 6 and d is from 0 to 12.

For example, the compounds of formula (I) may be

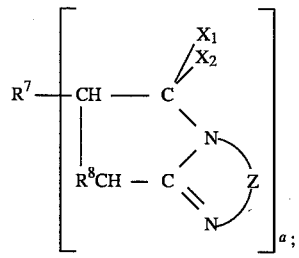

-continued

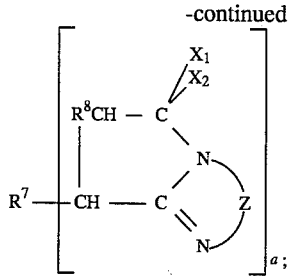

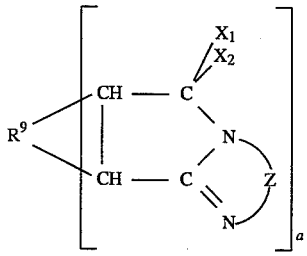

wherein $R^7$ is a hydrogen or a hydrocarbyl substituent having from 1 to 600 carbon atoms, $R^8$ is hydrogen or a $C_1$ to $C_{12}$ hydrocarbyl substituent, and if there is more than one $R^8$ in a compound, they may be the same or different, $R^9$ is a hydrocarbylene substituent having from 2 to 600 carbon atoms, two of which carbon atoms are bonded to the a-carbon atoms of the succinic anhydride based ring, $X_1$ represents hydrogen or an alkyl group having from 1 to 12 carbon atoms, $X_2$ represents hydrogen, an alkyl group having from 1 to 12 carbon atoms, a hydroxy group, or an alkoxy group, the alkoxy group having from 1 to 12 carbon atoms, or $X_1$ and $X_2$ may together represent an oxygen (or sulphur) atom, and a is 1 to 20.

Macrocyclic compounds such as the above are described in U.S. Pat. No. 4,637,886 and U.S. Pat. No. 4,880,923. When the invention is the use or the composition, the macrocyclic compound, if present, is advantageously in a proportion in the range of from 5 to 20,000 ppm of active ingredient by weight based on the weight of the fuel oil, preferably from 10 to 5,000, more preferably from 50 to 3,000.

(ii) Cetane Improvers

It has been found that using a cetane improver in combination with the additive of the invention and optionally with a macrocyclic compound as described above may give rise to operational benefit.

Preferred cetane improvers are organic nitrates; there may also be used, for example, substituted triazoles and tetrazoles, for example those described in European Patent Application No 230783. Preferred organic nitrates are nitrate esters containing aliphatic or cycloaliphatic groups with up to 30 carbon atoms, preferably saturated groups, and preferably with up to 12 carbon atoms. As examples of such nitrates, there may be mentioned methyl, ethyl, propyl, isopropyl, butyl, amyl, hexyl, heptyl, octyl, iso-octyl, 2-ethylhexyl, nonyl, decyl, allyl, cyclopentyl, cyclohexyl, methylcyclohexyl, cyclododecyl, 2-ethoxyethyl, and 2-(2-ethoxyethoxy) ethyl nitrates.

When the invention is the use or the composition, the cetane improver is advantageously present in the fuel in a proportion in the range of from 5 to 10,000 ppm of active ingredient by weight based on the weight of the fuel, preferably from 50 to 5,000, more preferably from 100 to 2,000.

(iii) Polymer of Monoolefin

The presence of a polymer of a $C_2$ to $C_6$ monoolefin, the polymer having a number average molecular weight of less than about 500, may also be advantageous. Such a polymer may, for example, be a homo- or copolymer of ethylene, propylene, butylene (1- or 2-), pentylene or isobutylene, polyisobutylene being preferred. When it is a copolymer, it may be a copolymer of two or more of the specified monomers, or a copolymer of one or more of the specified monomers with a copolymerisable unsaturated monomer. Further, it may be a block or a random copolymer.

The number average molecular weight is as measured by Gel Permeation Chromatography (GPC). Preferably, it is in the range of 300 to 500, more preferably 350 to 450. The polymer may, for example, have a kinematic viscosity at 100° C. in the range of 1 to 20 cSt, preferably 4 to 16 cSt, more preferably 8 to 12 cSt.

The polymer may be made, for example, by catalysed polymerisation using cationic catalyst systems described in the art such as $AlCl_3/H_2O$; $AlCl_3/HCl$; $Et\ AlCl_2/HCl$; $BF_3$; or Ziegler-Natta type catalysts.

When the invention is the use or the composition, the polymer is advantageously present in the fuel in a proportion in the range of from 5 to 10,000 ppm of active ingredient by weight based on the weight of the fuel, preferably from 50 to 5,000, more preferably from 100 to 2,000.

(iv) Other Additive Components

In the practice of this invention, the additive or co-additives, if present, may be used in combination with one or more other additives, for example additives providing particular properties such as dispersants, for example hydrocarbyl-substituted succinimides or succinamides and hydrocarbylpolyamines; metallic-based combustion improvers such as ferrocene; corrosion inhibitors; anti-oxidants such as amine-formaldehyde products; anti-foams; reodorants; anti-wear agents; flow improvers; wax antisettling additives or other operability improvers; and cloud point depressants.

Examples of the above other additive components are known in the art. Such other additives may, for example, be present in the fuel oil in a proportion in the range of 5 to 500 ppm (weight:weight).

PROPORTIONS

Where the additive of the invention is used in combination with one or more co-additives, the relative proportion of the additives to one another may, for example, be in the weight:weight ratio of 500:1 to 1:500 such as 10:1 to 1:10.

FUEL OIL

The fuel oils that can be used are petroleum compositions comprising hydrocarbons such as straight chain paraffins, branched chain paraffins, olefins, aromatic hydrocarbons, and naphenic hydrocarbons, and hetero-atom containing derivatives of the above. The components of the fuel oil can be derived by any of the conventional refining and blending processes. Synthetic fuels are also included.

The fuel oils can be middle distillate fuel oils such as diesel fuel, aviation fuel, kerosene, fuel oil, jet fuel and heating oil. Generally, suitable distillate fuels are those boiling in the range of 120° C. to 500° C. (ASTM D-86). A heating oil may have a specification with a 10% distillation point no higher than 226° C., a 50% distillation point no higher than 282° C., and a 90% distillation point of at least 282° C. and no higher than about 338° C. to 343° C. or possibly 357° C. Heating oils are preferably a blend of virgin distillate, e.g. gas oil or naphtha, and cracked distillate, e.g.

catalytic cycle stock. A diesel fuel may have a specification that includes a minimum flash point of 38° C. and a 90% distillation point between 282° C. and 338° C. (see ASTM Designations D-396 and D-975).

The additive and co-additives, if to be provided, may be added to the fuel oil as a mixture or separately in any order using conventional fuel additive injection methods, e.g. in the form of a concentrate. In a concentrate, the additive(s) may be dissolved in the solvent at a concentration within wide limits according to needs and restrictions, for example from 20 to 90, such as 30 to 80, per cent (weight:weight). Examples of such solvents are hydrocarbons or oxygen-containing hydrocarbons such as kerosene, aromatic naphthas, and mineral lubricating oils.

EXAMPLES

The invention will now be particularly described by way of example only as follows:

Example 1

An additive of the invention was tested in a truck engine to determine its effect on hydrocarbon, carbon monoxide, oxides of nitrogen, and particulate emissions. The engine used was a 6 liter 6 cylinder 4 stroke naturally aspirated DI truck engine.

The fuel used had the following characteristics:

Cloud point: −6° C.

Pour point: −27° C.

Cetane Number (CFR): 51.3

| Distillation Characteristics: | |
|---|---|
| Volume % Off | Temp (°C.) |
| Initial Boiling Point | 148 |
| 5 | 194 |
| 10 | 209 |
| 20 | 229 |
| 30 | 248 |
| 40 | 263 |
| 50 | 275 |
| 60 | 286 |
| 70 | 298 |
| 80 | 312 |
| 90 | 331 |
| 95 | 345 |
| Final Boiling Point | 367 |

The tests were run in the following manner according to a standard ECE R49 cycle:

1. The engine was warmed up over a period of 90 minutes to full speed and full load.
2. A stabilising test was run using untreated fuel.
3. A test was run on the untreated fuel and emission data were collected.
4. A test was run on fuel treated with 500 ppm (weight:weight) of an additive comprising 4-hydroxy-2,2,6,6-tetramethylpiperindinyloxy.

The results are summarised in Table 1 below:

TABLE 1

| | HC | CO | $NO_x$ | Particulates |
|---|---|---|---|---|
| Untreated Fuel | 1.195 | 5.306 | 8.520 | 1.097 |
| Treated Fuel | 0.958 | 3.816 | 9.371 | 0.784 |

All figures represent g/kWh of the indicated emission, HC being hydrocarbons, CO being carbon monoxide, NO being oxides of nitrogen, and PARTICULATES being particulate matter collected via a conventional dilution tunnel.

The above results show that the additive reduced each of the hydrocarbon, carbon monoxide and particulates emissions.

Example 2

The following formulations were used:

| Additive Formulation A (Comparison) | |
|---|---|
| Macrocycle** | 150 |
| Cetane Improver (Octyl Nitrate) | 750 |
| Polymer (polyisobutene; $M_N$ = 450) | 500 |
| *Anti-Foam (alkoxy-substituted poly-dimethy poly-siloxane) | 12.5 |
| *Solvent (aromatic hydrocarbon) | 52.5 |
| *Anti-Rust (alkoxy-substituted alkylphenol) | 20 |
| *Demulsifier | 15 |
| Total: | 1500 |

*A cyclic acyl amidine compound of the type described in U.S. Pat. Nos. 4,637,886 and 4,880,923.

| Additive Formulation B | |
|---|---|
| Macrocycle (as used in Additive Formulation A) | 150 |
| Cetane Improver (Octyl Nitrate) | 750 |
| Polymer (polyisobutene; $M_N$ = 450) | 500 |
| Nitroxide (as in Example 1) | 50 |
| Solvent (aromatic hydrocarbon) | 1050 |
| Total: | 2500 |

In the above formulations, the numbers indicate quantities in ppm (weight:weight) present in the fuel when tested The components marked with a single asterisk are believed to have no significant effect on emissions.

The above additive formulations (A and B) were each tested in a car engine to determine their effects on hydrocarbon, carbon monoxide, oxides of nitrogen, and particulate emissions. The engine used was a 1.7 liter naturally aspirated IDI passenger car engine.

The fuel used had the same characteristics as the fuel used in Example 1.

The tests were carried out in accordance with a standard ECE 15.04+EUDC registered cycle and were carried out using untreated fuel and fuels containing each of additives A and B.

The results are summarised in Table 2 below.

TABLE 2

| | HC | CO | $NO_x$ | Particulates |
|---|---|---|---|---|
| Untreated Fuel | 1.61 | 8.32 | 9.92 | 1.40 |
| Fuel with Additive A | 3.35 | 8.48 | 10.3 | 1.20 |
| Fuel with Additive B | 1.08 | 7.49 | 10.6 | 1.11 |

The figures represent quantities as described for Table 1.

The results show that Additive B (of the invention) reduces emissions of hydrocarbons, carbon monoxide, and particulates when compared with the untreated fuel and with Additive A (comparison).

We claim:

1. A composition comprising a major proportion of a fuel oil and a minor proportion of an additive comprising an oil-soluble stable free radical or a precursor therefor that is convertible to an oil-soluble stable free radical under combustion of said composition, the minor proportion of additive being less than 100 ppm such that it is incapable of increasing the cetane number of the fuel oil.

2. The composition of claim 1 wherein the nitroxide is of the formula:

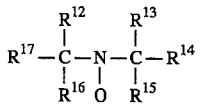

wherein each of $R^{17}$, $R^{12}$ and $R^{13}$ and $R^{14}$ is a hydrocarbyl group or hetero-atom substituted hydrocarbyl group having 1 to 200 carbon atoms, $R^{15}$ and $R^{16}$ (a) each being a hydrocarbyl group having 1 to 200 carbon atoms, or a substituted hydrocarbyl group having 1 to 200 carbon atoms wherein the substituent is halogen, cyano, —$CONH_2$, $SC_6H_5$, —S—$COCH_3$, —$OCOCH_3$, — $OCOC_2H_5$, carbonyl, alkenyl wherein the double bond is not conjugated with the nitroxide moiety, or —COOR wherein R of the —COOR group is alkyl or aryl, or (b) together forming part of a ring that contains carbon atoms and up to two hetero-atoms of O, N or S, optionally linked to a side chain for enhancing the solubility of the free radical in a fuel oil.

3. The composition of claim 2 wherein one or more of the hydrocarbyl groups is an alkyl group having 1 to 15 carbon atoms.

4. The composition of claim 2 or claim 3 wherein the ring contains 4 or 5 carbon atoms.

5. The composition of any of claim 4 wherein each of $R^{17}$, $R^{12}$, $R^{13}$ and $R^{14}$ is a methyl, ethyl or propyl group.

6. The composition of any of claim 5 wherein each of $R^{15}$ and $R^{16}$ is a methyl, ethyl or propyl group.

7. The composition of any of claim 5 wherein the nitroxide is 4-hydroxy-2,2,6,6-tetramethylpiperindinyloxy.

8. The composition of claim 1 wherein the fuel oil is a middle distillate petroleum fuel oil.

9. The composition of claim 1 wherein the proportion is in the range of 10 to 80 ppm.

10. The composition of claim 1 wherein the additive is present in combination with one or more co-additives.

11. The composition of claim 10 wherein the or one of the co-additives is an oil soluble compound of the formula

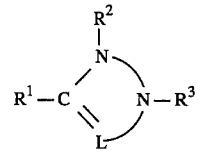

(I)

or $R^6R^4N(R^5)_b[NR^4(R^5)_e]_dNR^4NR^4$ or mixtures of two or more such compounds, wherein $R^1$, $R^2$ and $R^3$ may be the same or different and are independently hydrogen or a hydrocarbyl substituent having from 2 to 600 carbon atoms, or a keto, hydroxy, nitro, cyano, or alkoxy derivative thereof, provided that at least one of $R^1$, $R^2$ and $R^3$ is a hydrocarbyl substituent having from 2 to 600 carbon atoms or said derivative thereof, or wherein $R^1$ and $R^2$ together form a hydrocarbylene substituent having 4 to 600 carbon atoms or a keto, hydroxy, nitro, cyano or alkoxy derivative thereof, provided that $R^1$ and $R^2$ together with the carbon atom which forms the C-R1 bond with $R^1$ and the nitrogen atom which forms the N-$R^2$ bond with $R^2$ form a ring having at least 5 members, wherein Z represents $$—R^{10}[NR^{11}(R^{10})]_e—$$

or $$—[R^{10}R^{11}N]_fR^{10}[NR^{11}R^{10}]_g—$$

wherein each $R^{10}$, which may be the same or different, represents an alkylene group having from 1 to 5 carbon atoms in its chain, $R^{11}$ represents a hydrogen atom or a hydrocarbyl group, and e is from 0 to 6, f is from 1 to 4, g is from 1 to 4, provided that f+g is at most 5, each $R^4$ is independently H or an alkyl group having up to 5 carbon atoms, $R^5$ is an alkylene group having up to 6 carbon atoms in the chain, optionally substituted by one or more hydrocarbyl groups having up to 10 carbon atoms, an acyl group having from 2 to 10 carbon atoms, or a keto, hydroxy, nitro, cyano or alkoxy derivative of a hydrocarbyl group having from 1 to 10 carbon atoms or of an acyl group having from 2 to 10 carbon atoms, R6 is a hydrocarbyl substituent having from 2 to 600 carbon atoms or said derivative thereof, b is from 1 to 6, c is from 1 to 6 and d is from 0 to 12.

12. The composition of claim 11 wherein the compound of formula (I) is

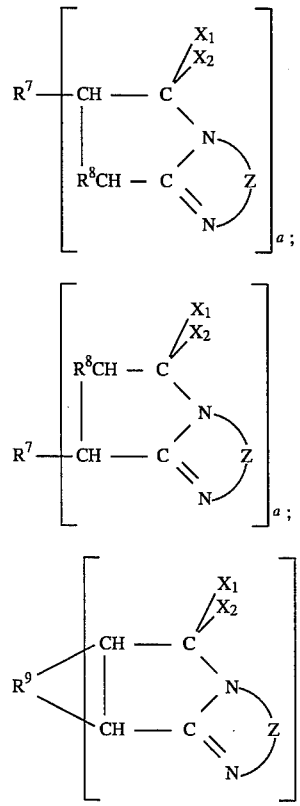

wherein $R^7$ is a hydrogen or a hydrocarbyl substituent having from 1 to 600 carbon atoms, $R^8$ is hydrogen or a $C_1$ to $C_{12}$ hydrocarbyl substituent, and if there is more than one $R^8$ in a compound, they may be the same or different, $R^9$ is a hydrocarbylene substituent having from 2 to 600 carbon atoms, two of which carbon atoms are bonded to the a-carbon atoms of the succinic anhydride based ring, $X_1$ represents hydrogen or an alkyl group having from 1 to 12 carbon atoms, $X_2$ represents hydrogen, an alkyl group having from 1 to 12 carbon atoms, a hydroxy group, or an alkoxy group, the alkoxy group having from 1 to 12 carbon atoms, or $X_1$ and $X_2$ may together represent an oxygen (or sulphur) atom, and a is 1 to 20.

13. The composition of claim 12 wherein one or both of $R^7$ and $R^9$ is or is derived from a $C_2$ to $C_5$ olefin polymer.

14. The composition of claim 13 wherein the polymer is polyisobutylene.

15. The composition of any of one claims 11 to 14 wherein the co-additive is present in the fuel oil in a proportion-in the range of from 50 to 20,000 ppm of active ingredient by weight based on the weight of the fuel oil.

16. The composition of claim 15 wherein the proportion is in the range of 10 to 500 ppm.

17. The composition of claim 10 wherein the or one of the co-additives is a cetane improver.

18. The composition of claim 17 wherein the cetane improver is an aliphatic or cycloaliphatic nitrate.

19. The composition of claim 18 wherein the nitrate is an alkyl or cycloalkyl nitrate containing up to 30 carbon atoms.

20. The composition of any one of claims 17 to 19 wherein the cetane improver is present in the fuel oil in a proportion in the range of from 5 to 10,000 ppm of active ingredient by weight based on the weight of the fuel oil.

21. The composition of claim 20 wherein the proportion is from 50 to 2000 ppm.

22. The composition of claim 10 wherein the or one of the co-additives is a polymer of a $C_2$ to $C_6$ mono-olefin, the polymer having a number average molecular weight of less than about 500.

23. The composition of claim 22 wherein the polymer is polyisobutylene.

24. A method for operating a diesel engine to reduce one or more of particulate emissions, hydrocarbon emissions, carbon monoxide emissions, and oxides of nitrogen emissions in operation of the engine, which method comprises combusting in the engine a composition comprising a major proportion of a fuel oil and a minor proportion of an additive comprising an oil-soluble stable free radical or a precursor therefor that is convertible to an oil-soluble free radical under said combusting, the minor proportion of additive being such that it is incapable of increasing the cetane number of the fuel oil.

* * * * *

UNITED STATES PATENT AND TRADEMARK OFFICE

CERTIFICATE OF CORRECTION

PATENT NO. : 5,460,634

DATED : October 24, 1995

INVENTOR(S) : Carlo Fava et al

It is certified that error appears in the above-indentified patent and that said Letters Patent is hereby corrected as shown below:

Column 9, line 9 preceding the term "nitroxide" insert the terms --stable free radical is a--.

Column 9, claims 5, 6 and 7, delete the terms "any of".

Column 9, lines 54 and 55:
In claim 11, in the formula, change "N-$R^3$" to --Z-$R^3$-- and "L" to --N--.

Column 11, line 18, delete "the or"

Column 12, line 5, delete "the or"

Signed and Sealed this

Ninth Day of April, 1996

Bruce Lehman

*Attest:*

BRUCE LEHMAN

*Attesting Officer*

*Commissioner of Patents and Trademarks*